US007059660B1

(12) United States Patent
Juola

(10) Patent No.: US 7,059,660 B1
(45) Date of Patent: Jun. 13, 2006

(54) TRUCK BED MOUNTED SUNSHADE

(75) Inventor: Gary Ernest Juola, 2248 Amelia Ct., Signal Hill, CA (US) 90755

(73) Assignee: Gary Ernest Juola, Signal Hill, CA (US)

( * ) Notice: Subject to any disclaimer, the term of this patent is extended or adjusted under 35 U.S.C. 154(b) by 0 days.

(21) Appl. No.: 10/906,161

(22) Filed: Feb. 4, 2005

Related U.S. Application Data

(60) Provisional application No. 60/541,827, filed on Feb. 5, 2004.

(51) Int. Cl.
*E04H 15/06* (2006.01)

(52) U.S. Cl. ..... 296/163; 135/88.03; 135/88.01

(58) Field of Classification Search ..... 296/163; 135/88.01, 88.03, 88.05
See application file for complete search history.

(56) References Cited

U.S. PATENT DOCUMENTS 4,519,409 A * 5/1985 Kinney et al. ..... 135/88.08
5,660,425 A * 8/1997 Weber ..... 296/163
6,202,664 B1 * 3/2001 Shenton et al. ..... 135/88.03
6,394,118 B1 * 5/2002 Cikanowick et al. .... 135/88.06

* cited by examiner

*Primary Examiner*—Joseph D. Pape

(57) ABSTRACT

An awning apparatus for mounting on the bed of a truck is comprised of a plurality of post assemblies, wherein each post assembly is designed to fit into the posthole of a truck bed, a plurality of collapsible tent pole assemblies inserted into the post assemblies and a flexible sheet member attached to the tent pole assemblies. A pair of cords are arranged such that one cord is attached to the flexible sheet member near the forward corner opposite the forward most post assembly and the other cord is attached to the flexible sheet member near the aft corner opposite the aft post assembly and the other ends of the cords are attached to the sub-frame of the truck, such that the tent pole assemblies extend outboard of the truck bed and are bent into an arched shape.

8 Claims, 6 Drawing Sheets

TRUCK BED MOUNTED SUNSHADE

CROSS-REFERENCE TO RELATED APPLICATION

This application claims priority based upon my co pending Provisional Application Ser. No. 60/541,827, filed on Feb. 5, 2004.

BACKGROUND OF INVENTION

1. Field of the Invention

The invention presented relates generally to awnings and especially awnings or canopies attached to a motor vehicle. In this application the motor vehicle is a truck where the awning attaches to the side of the truck bed and can provide shelter either to the side of the truck bed or over the truck bed.

2. Description of Related Art

Several different awnings and shelters have been described in prior art. Several of these awnings have also been attached to vehicles such as bicycles, golf carts, boats, automobiles and trucks. Awnings and shelters that attach to trucks have been outlined in U.S. Pat. Nos. 6,202,664 B1, 5,660,425, 5,417,469 and 6,394,118 B1. Although these devices seem to be effective shelters, none of them appear to be economical to produce, lightweight, and have the capability to break down into a compact package for easy storage. None of the prior art utilizes lightweight flexible tent poles to achieve an efficient hoop-tension type structure, which is one key advantage of the present invention.

U.S. Pat. No. 6,202,664 B1 discloses an awning capable of sheltering the side of a truck bed, and converting to provide shelter over the truck bed by releasing a mechanism and rotating the awning into the alternate position. This apparatus also extends vertically to adjust the height of the awning for different applications. The complexity of the mechanism and the weight associated with the rigid members used to support the awning most likely cause it to be costly to produce, heavy and bulky when stored. These factors tend to distract from its apparent attractiveness, which is evident by the fact that its use to date in the field has been minimal at best. It would be desirable to avoid costly mechanisms and multiple part assemblies when trying to devise a simple and economical awning.

U.S. Pat. No. 5,660,425 discloses a shelter apparatus that is partially supported by the rear portion of a truck bed and partially supported by the ground. This device extends aft of the vehicle, and therefore is limited to provide protection aft of the vehicle only. It would be desirable to be able to protect the area to the side of the truck bed, thereby effectively using the vehicle to amplify the benefit of the shelter. It would also be desirable to be able to reposition the vehicle without removal of the shelter. Supporting the shelter by making contact with the ground makes this difficult to accomplish.

U.S. Pat. No. 5,417,469 discloses yet another canopy apparatus that is partially supported by the rear portion of a truck bed and partially supported by the ground.

U.S. Pat. No. 6,394,118 B1 discloses a canopy structure that is anchored by the rear wheels of a truck. This canopy also extends aft of the truck to provide shelter in that area. The structure of this apparatus is comprised of a several piece frame attached to two heavy based plates that are secured between the rear wheels of the truck and the ground. This apparatus appears to be quite complex, difficult to set up, difficult to take down and quite costly to produce. Again, it would be desirable for a shelter to be attached only to the truck so that the vehicle could be repositioned if desired. Minimizing the complexity of the supporting structure and providing a lightweight package are important aspects for canopy that is easily erected, dismantled and packaged for compact storage.

As can be seen by the foregoing descriptions of prior art, shelters attached to vehicles, and especially truck beds are well known, however, none of the prior art satisfies the following combination of requirements that were set forth prior to the discovery of the disclosed invention: (1) provide a economical shelter for the protection of persons seated or standing along side a truck bed or inside of the truck bed. (2) Be easily erected and easily disassembled by one man (3) complex, part-extensive features must be avoided to minimize cost, weight, part-count and complexity. (4) The shelter must be entirely supported by the truck so that the truck can be repositioned without removing or disassembling the shelter. (5) The shelter must be capable of withstanding gusty winds and rain. (6) The shelter, when disassembled and stowed, must be smaller than 8" in diameter and 30" long. (7) The shelter must be adaptable to a majority of pickup truck bed types to maximize market exposure.

SUMMARY OF THE INVENTION

The present invention, as will be described, is a compact lightweight awning that attaches to the side of a truck bed. The awning can be positioned to provide shelter over the truck bed or for the area beside the truck bed. The advantages of the present invention over prior art will be evident and are due primarily to its unique configuration comprised of a single flexible sheet, four collapsible tent pole assemblies, four lengths of cord and two truck bed adapter devices.

The present invention utilizes two different methods of attaching the awning to the truck bed. The attachment method is dependent on the features of the truck bed itself. The most common method of attaching the awning to the truck is by making use of the postholes found in most truck beds. Two truck bed adapter fittings, one inserted into the forward truck bed posthole and one inserted into the aft truck bed posthole, are used to anchor the awning to the truck. Each adapter fitting contains a socket that accepts a cylindrical tent pole, which form the forward and aft outreaching members of the awning's structure. The flexible sheet has forward and aft full-length pockets sewn closed at one end that accept the forward and aft tent poles. A nylon cord is tied to the forward and aft ends of the flexible sheet opposite the adapter fittings. The other end of the nylon cord is attached to the sub frame of the truck. The lengths of the nylon cords are adjusted to give the awning an arched shape. A second set of fiberglass poles are inserted though a loop in the center of the awning. The ends of the second pair of poles are inserted into pockets sewn into each corner of the flexible sheet so that the second set of poles cross each other near the center loop of the awning. The second set of poles are a predetermined length so that they conform to the arch shaped awning and provide a fore and aft separating force that give the awning added shape and tautness. The awning is anchored to the truck with two cords. One cord is attached to the flexible sheet near the forward adapter fitting and the other cord is attached to the flexible sheet near the aft adapter fitting. The opposite ends of the cords are attached to the truck bed.

The adapter fittings are designed to accommodate both awning positions by utilizing a second tent-pole-accepting socket. The tent pole sockets are situated at predetermined angles to give the awning proper height and reach.

The second method of attaching the awning to the truck bed is used on trucks that do not have bedside pockets. These trucks require the use of an adapter fitting which is supported by the upper inside truck bed rail edge, the floor of the truck bed and a threaded hook arrangement that hooks onto the eyelet supplied on the truck bed. This adapter fitting also has two sockets that are set at predetermined angles to accept the tent poles and provide the two alternate awning arrangements—side of truck bed and over the truck bed.

As can be seen from the preceding brief explanation the invention has some distinct advantages over prior art with respect to part count, simplicity and cost without loosing sight of the foregoing initial requirements. The objectives of the present invention are as follows:

It is the main objective of the invention to provide shelter to persons standing or sitting beside or inside of a truck bed.

It is another object of the present invention is to provide a truck bed mounted shelter that is economically produced and therefore low cost for the consumer.

It is another object of the present invention to provide the user with a shelter that is easy to erect.

It is another object of the present invention to provide the user with a shelter that is easy to disassemble.

It is another object of the present invention to provide the user with a shelter that stores in a compact package.

It is another object of the present invention to provide the user with a shelter that is attached to a truck that is capable of being moved with the shelter attached.

It is another object of the present invention to provide the user with a shelter that will withstand strong gusty winds and rain without damage to the canopy or the attaching truck.

These objectives of the invention will be evident by a further description of the accompanied drawings, which are part of this disclosure. The claims section, annexed to, and forming part of this disclosure, will summarize the innovative aspects of the present invention.

BRIEF DESCRIPTION OF THE DRAWINGS

The annexed drawings are provided to aid in the description of the invention. A detail description of the invention with use of the drawings follows this brief description of the drawings.

DESCRIPTION OF THE PREFERRED EMBODIMENT

The drawings described above will be used for a detail description of the preferred embodiment of the invention.

Figure 1:
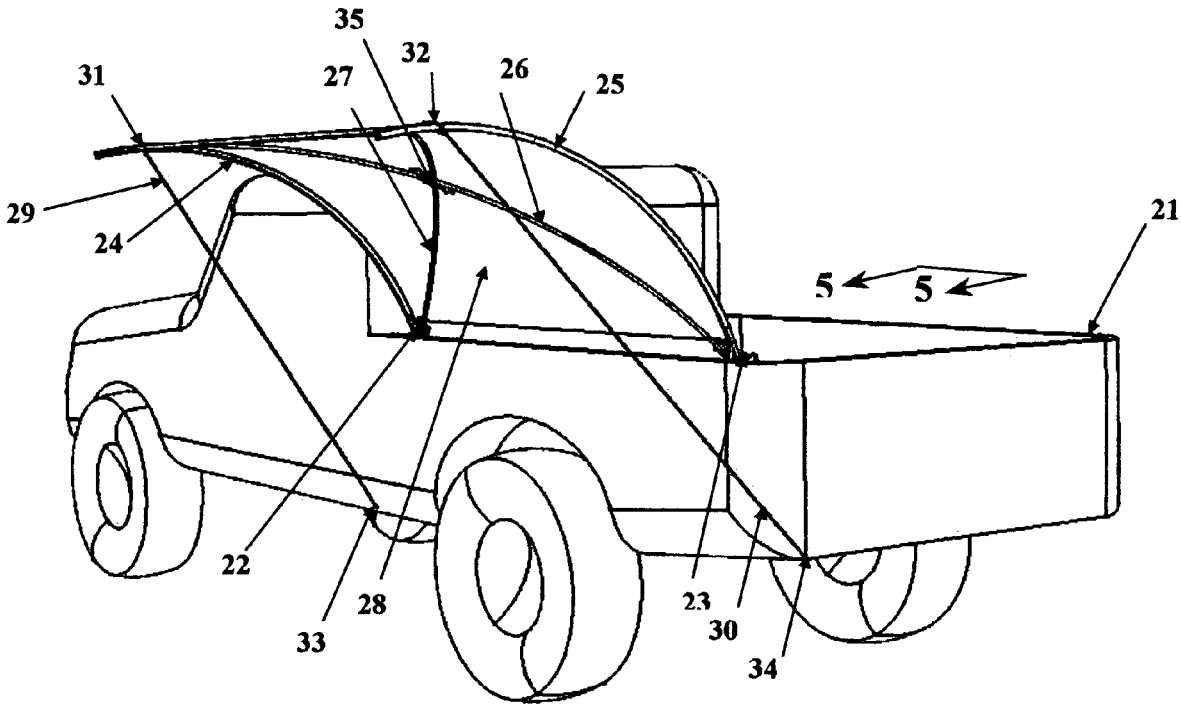
FIG. 1 is a perspective view of the truck bed mounted sunshade mounted to the truck bed. This view shows the invention mounted to the side of the truck bed.

FIG. 1 shows a rear perspective view of the truck bed mounted sunshade. Adapter fitting assemblies 22 and 23 are firmly attached to truck bed 21 to support the tent pole assemblies 24, and 25. Attached to tent pole assemblies 24, and 25 is flexible sheet 28, which has full length pockets sewn on the fore and aft sides housing tent pole assemblies 24 and 25. Additional pockets are sewn on each corner of flexible sheet 28 to capture the ends of the diagonal pole assemblies 26 and 27. Loop 35 is sewn onto flexible sheet 28 near the center to capture and help stabilize pole assemblies 26 and 27. Cords 29 and 30 are attached to flexible sheet 28 at locations 31 and 32. The opposing ends of cords 29 and 30 are attached to the truck sub frame at locations 33 and 34. The lengths of cords 29 and 30 are adjusted to provide tension in pole assemblies 24 and 25 giving the canopy an arched shape and holding it taunt. Pole assemblies 26 and 27 provide the fore and aft tension forces necessary to hold the shape and stabilize the canopy. The inboard edge of flexible sheet 28 is anchored to the truck bed, or to the attach fittings, with fore and aft cords depicted as item 46 in FIG. 8. The lengths of cords 29 and 30 are adjustable to adapt to different truck bed designs, user attach point preferences, and to provide a means to accommodate the "over-the-bed" installation shown in FIG. 2.

Figure 2:
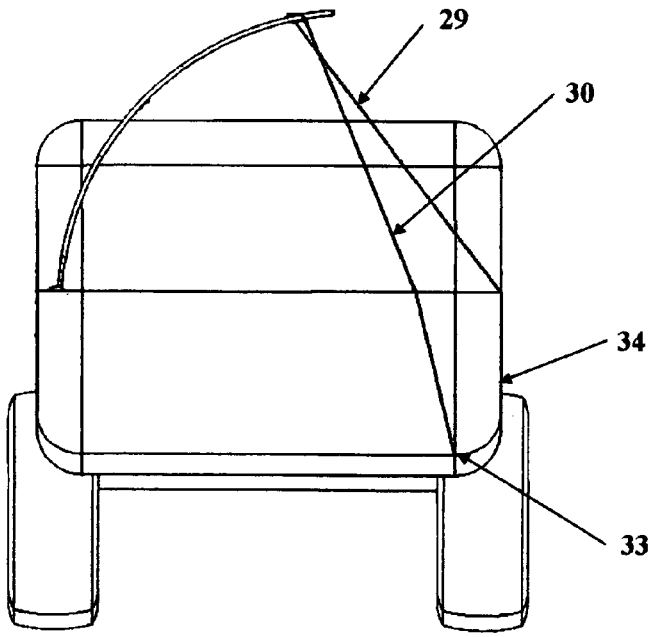
FIG. 2 is a rear view of the truck bed mounted sunshade shown in the alternate position providing protection for the truck bed.

FIG. 2 is a rear view of the "over-the-bed" installation. Cords 29 and 30 are attached to flexible sheet 28 as previously described. The opposing ends of cords 29 and 30 are attached to the truck sub frame or the to features inside of the truck bed depicted by locations 33 and 34. The lengths of cords 29 and 30 are adjusted to provide tension in pole assemblies 24 and 25 giving the awning an arched shape and holding it taunt. The lower awning edge is anchored to the truck bed via cords as described earlier.

Figure 3:
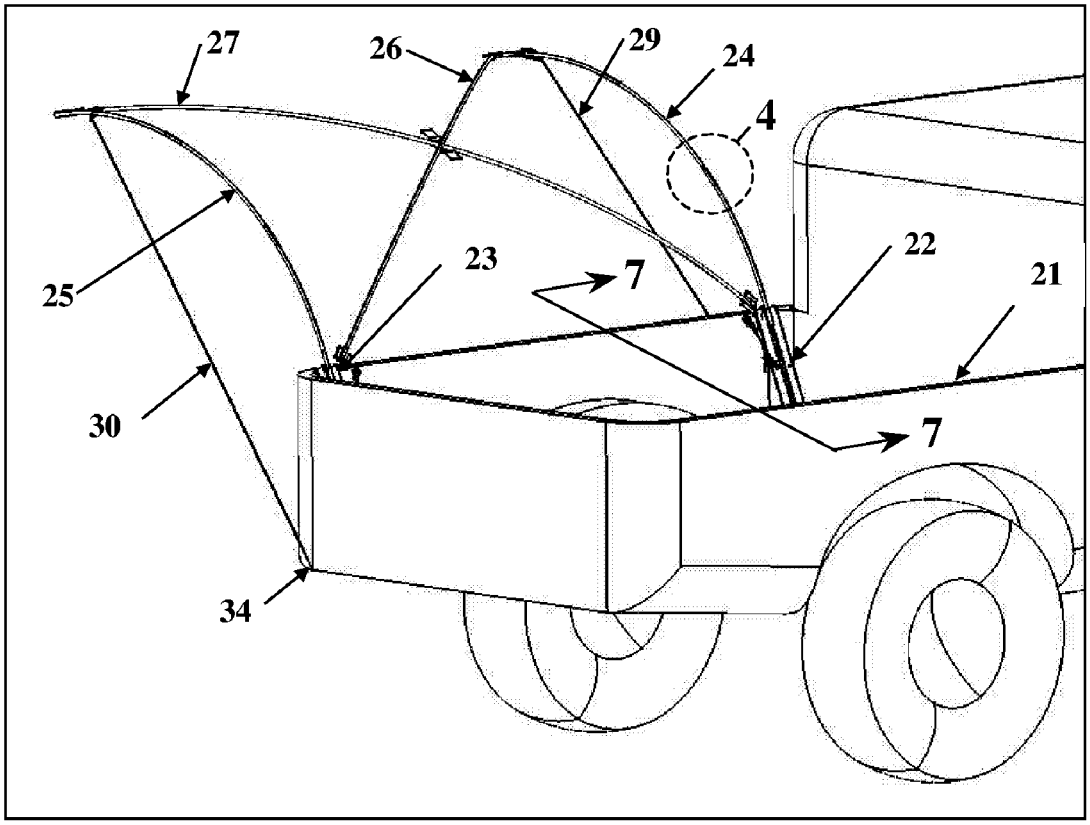
FIG. 3 is a perspective view showing the basic structure of the awning without the flexible sheet.
Figure 4:
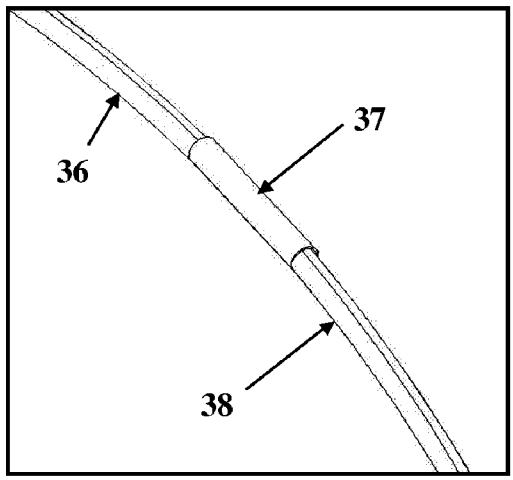
FIG. 4 is a detail view taken from FIG. 3 of a typical tent pole joint arrangement used so the poles can be stowed in a compact container.

FIG. 3 shows the structure used to support the awning. The tent pole assemblies are cylindrical flexible material comprised of segments of predetermined lengths attached together with pole-segment-overlapping ferrules. FIG. 4 shows a typical tent pole assembly joint where pole segments 36 and 38 are inserted into ferrule 37. The pole assemblies are held together via tension in an internal bungee cord. This feature allows the pole segments to be pulled out of the overlapping ferrules and folded for compact storage. Pole assemblies 24, 25, 26 and 27 are built with this method. The lengths of the segments are designed to be similar providing added storage convenience.

Figure 5:
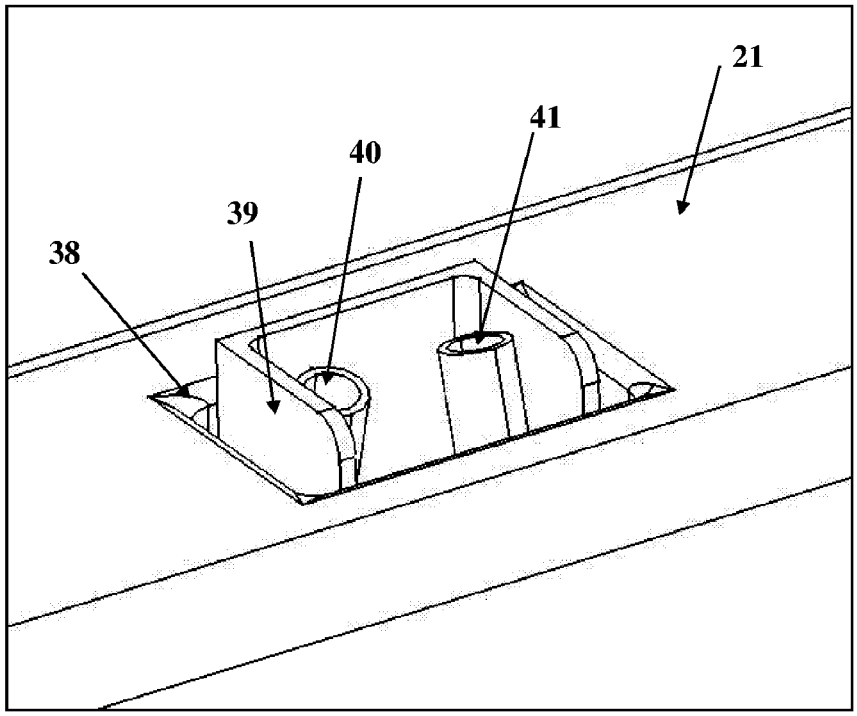
FIG. 5 is taken from FIG. 1 line 5—5 showing the first type adapter fitting installed in the truck bed posthole.
Figure 6:
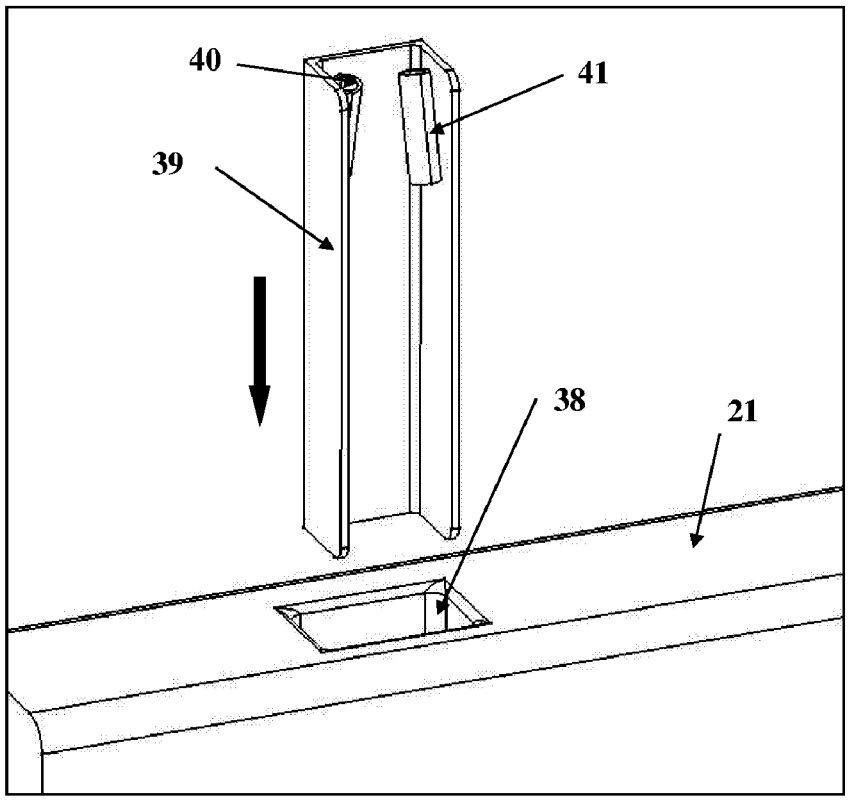
FIG. 6 is an exploded view showing the same first type adapter fitting, the truck bed and posthole.

Many truck beds are designed with bedside pockets or postholes. FIG. 5 shows the first type adapter fitting assembly, depicted as 39, installed into the truck bed posthole. Sockets 40 and 41 are integral to attach fitting 39 and are designed to accept pole assemblies 24 and 25. The sockets 40 and 41 are set at predetermined angles to provide correct awning height and outreach. FIG. 6 is an exploded view showing how the first type adapter fitting is inserted into the truck bedpost hole. For this type of adapter fitting, cord 46 shown in FIG. 8 can be anchored to any existing feature in the truck bed thereby holding the awning taunt in the lateral direction and anchoring the awning to the truck bed.

Figure 7:
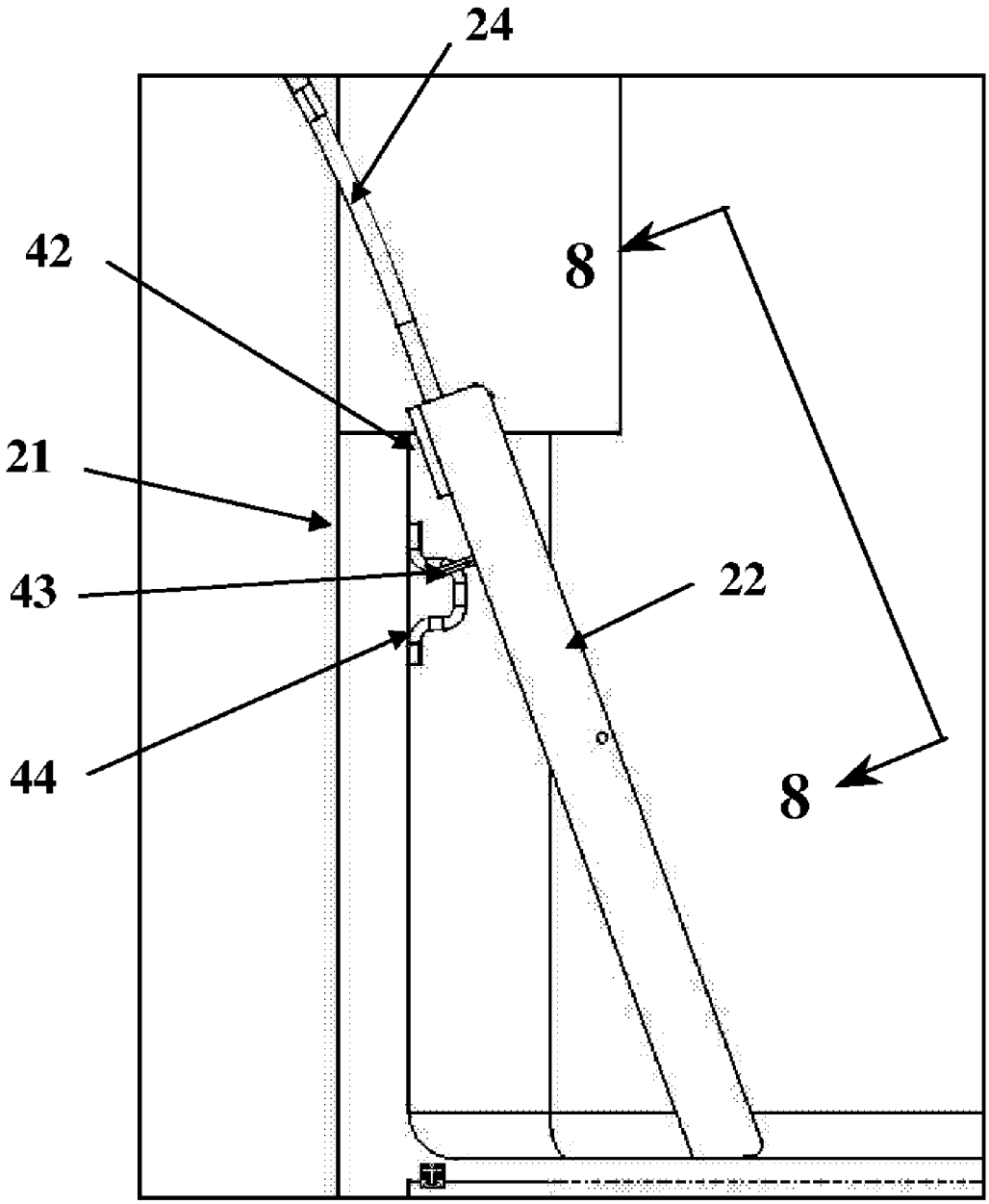
FIG. 7 is taken from FIG. 3 line 7—7 showing the second type adapter fitting installed in the truck bed.
Figure 8:
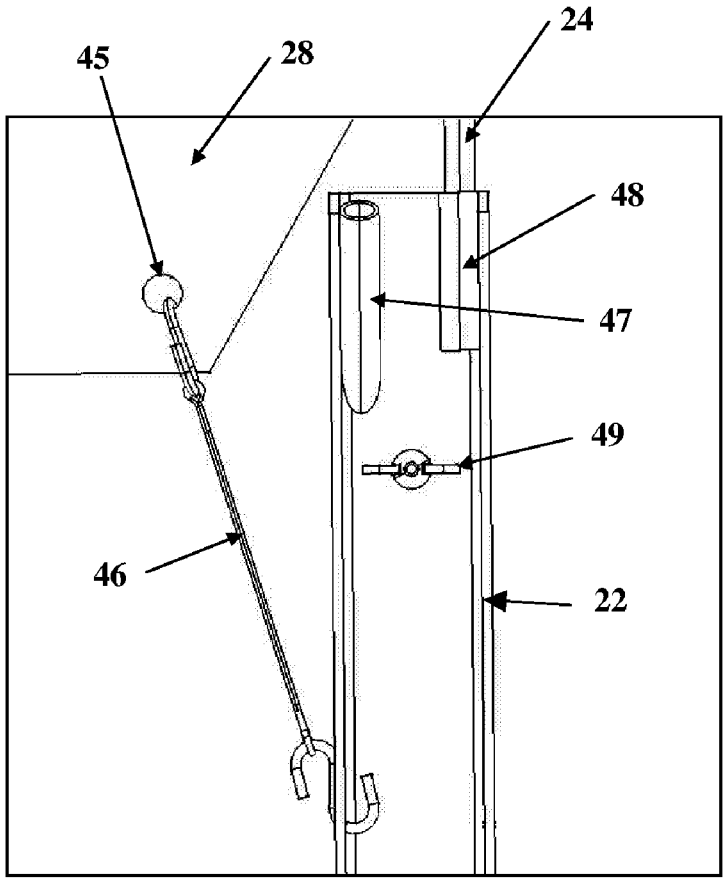
FIG. 8 is taken from FIG. 7 line 8—8 showing the second type adapter fitting and the awning attachment.
Figure 9:
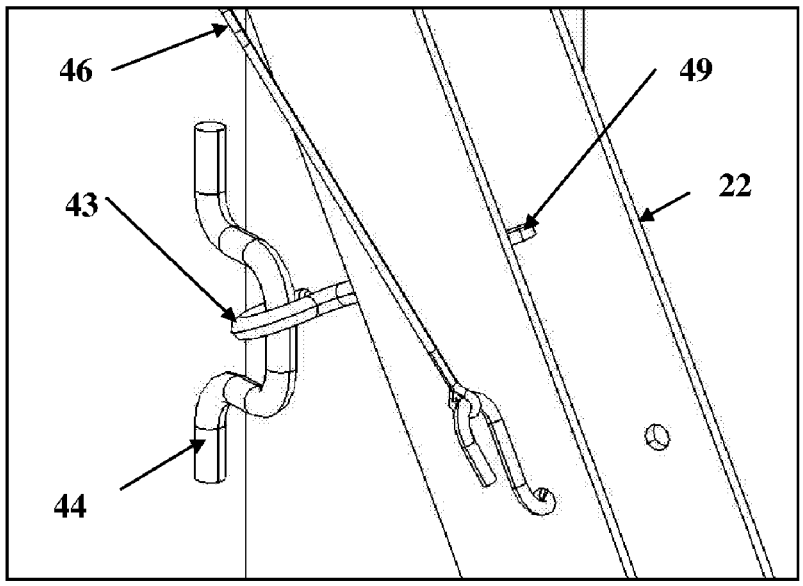
FIG. 9 is a canted perspective view of the same second type adapter fitting showing how it is anchored to the truck bed.

Not all trucks have bedside pockets, or postholes. For these trucks a special adapter fitting had to be invented. FIGS. 7, 8 and 9 show the details of the unique second type adapter fitting depicted by 22 installed into truck bed 21. This second type adapter fitting is comprised of a main beam supported by the upper inside edge of the truck bed on one end, by the floor of the truck bed at the other end and is fastened to truck bed 21 with "J" hook 43 and an existing truck bed eyelet feature 44. Tension is induced into "J" hook 43 via wing nut 49 (FIG. 8) thereby compressing rubber cushion 42 against truck bed 21. This tension force provided by "J" hook 43 and the friction force provided by cushion 42 firmly attach the fitting to truck bed 21. Sockets 47 and 48 integral to the second type attach fitting are used to accept pole assemblies 24 and 25, thereby providing the two awning mounting positions—side of the truck bed and over the truck bed. Sockets 47 and 48 are closed on the lower end to prevent the tent pole assemblies from sliding through the mounting feature. Socket 48 is parallel to member 22 upon installation against the truck bed 21. Socket 47 is situated at a predetermined angle to provide proper height and outreach of the awning for the over the truck bed awning position.

FIG. 8 shows the flexible sheet 28 attached to the second type adapter fitting depicted by 22. Cord 46 is attached to flexible sheet 28 and the second type adapter fitting 22. This secures the canopy to the truck.

Figure 10:
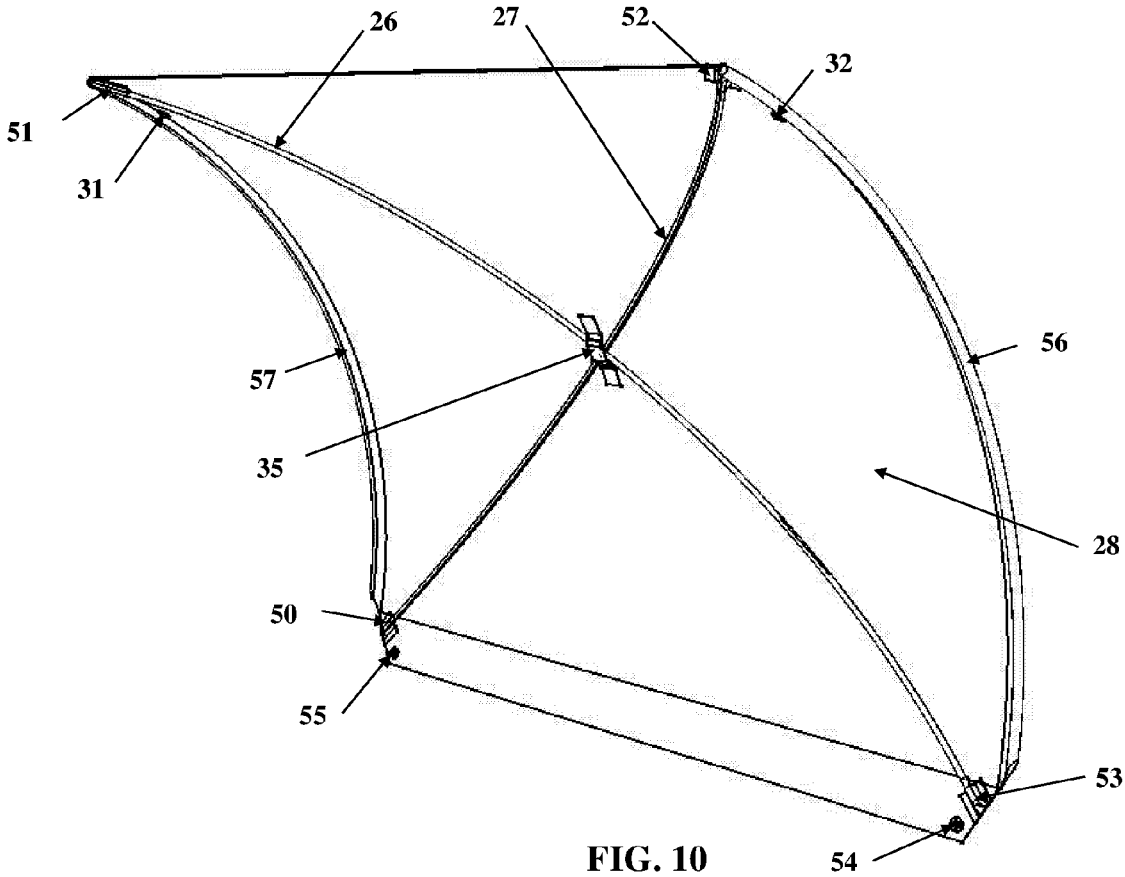
FIG. 10 is a canted perspective view looking inside of the awning without the truck, showing the arrangement of the tent pole loops and pockets.

FIG. 10 shows a perspective view of flexible sheet 28 without the truck. Flexible sheet 28 can be made from any flexible material depending on cost and the intended degree of protection. The material comprising flexible sheet 28 must have the ability to withstand the tension and point loads introduced to the awning by the pole assemblies and the tie-down cords. Flexible sheet 28 includes several features used to house the tent poles and tie the awning to the truck. Pockets for tent poles 24 and 25 are shown as members 56 and 57. Items 50, 51, 52 and 53 depict the pockets that house the ends of tent pole assemblies 26 and 27, and the center loop that captures poles 26 and 27 is depicted by item 35.

Mounting of the awning is a quick and simple process. The forward and aft adapter fittings are first secured to the truck, or installed in the bedside postholes. Inserting the pole segment ends into the ferrules extends the tent pole assemblies 24, 25, 26 and 27. Extended pole assemblies 24 and 25 can then be inserted into the pockets 56 and 57 sewn into the fore and aft sides of flexible sheet 28. The assembly can now be mounted to the truck bed by inserting poles assemblies 24 and 25 into the adapter fitting sockets. Fore and aft cords 46 are then attached to either the truck bed (for the first type adapter fittings) or to the second type adapter fittings. Cords 29 and 30 are then attached to the flexible sheet and the lower frame of the truck. Extended pole assemblies 26 and 27 are installed by slipping one end of each pole assembly through the center loop 35 and then inserting each end into a corner pocket.

Disassembly can be accomplished by reversing this procedure. The poles are then collapsed as described earlier and the flexible sheet folded. Attach fitting assemblies are removed and the hardware can then be stored in a small case or sack.

There are many different configurations of truck beds and devices provided by truck manufacturers to anchor cargo to truck beds. The adapter fittings, the awning structure and the awning itself described herein should not be regarded as limited based on the terminology or phraseology used herein. Variations to the invention could be accomplished to fit the various trucks manufactured in the past and in the future. The invention itself should not be considered limited base on minor variations of the preferred embodiment herein described.

What is claimed is:

1. A collapsible canopy apparatus for mounting on the side of a truck bed, the truck bed having a floor, a sub frame, and a side wall with an upper inside rail and an eyelet feature the apparatus comprising:

forward and aft adapter fittings each attached to the side wall at respective corners of said truck bed on the same side of said truck bed;

forward and aft pole assemblies attached to respective said adapter fittings such that distal ends of said forward and aft pole assemblies extend outboard from the side of said truck bed;

a rectangular flexible sheet member attached to said forward and aft pole assemblies such that said flexible sheet member provides a covered canopy region underneath;

forward and aft diagonal cords attached to said flexible sheet member near the corners of said flexible sheet member distal to said adapter fittings with opposite ends of said forward and aft diagonal cords attached to the sub frame of the truck and below said adapter fittings such that said forward and aft pole assemblies and said flexible sheet member are bent into an arcuate shape;

two diagonal pole assemblies longer than and attached to the underside of said flexible sheet member such that each end of each said diagonal pole assemblies reaches to different corners of said flexible sheet member causing said diagonal pole assemblies to induce forward, aft, inboard, outboard and upward forces into said flexible sheet member holding it taunt and in an arcuate shape;

forward and aft tie down cords attached to the said flexible sheet member near the forward and aft corners adjacent said forward and aft adapter fittings with opposing ends of said forward and aft tie down cords attached to the inside of said truck bed.

2. A collapsible canopy apparatus set forth in claim 1, with said forward and aft pole assemblies and said diagonal pole assemblies comprising a plurality of tubular pole elements adapted to be joined end-to-end at a joint into a unitary flexible pole and an elastic cord extending through a hollow lumen of each of said pole segments thereby providing a means to disengage said tubular pole elements such that said forward and aft pole assemblies and said diagonal pole assemblies can be folded and stored in a compact space.

3. A collapsible canopy apparatus set forth in claim 1, wherein said forward and aft pole assemblies are adapted to be attached to respective said forward and aft adapter fittings such that distal ends of said forward and aft pole assemblies extend inboard from the side of said truck bed positioning said canopy apparatus over said truck bed thereby providing a covered canopy region underneath.

4. A collapsible canopy apparatus set forth in claim 1, wherein said forward and aft adapter fittings include two sockets positioned at predetermined angles to said truck bed providing means to mount two of said collapsible canopy apparatus simultaneously, positioning one said canopy apparatus over said truck bed thereby providing a covered canopy region underneath and another said canopy apparatus over an area to the side of said truck bed thereby providing a covered canopy region underneath.

5. A collapsible canopy apparatus set forth in claim 1, wherein said forward and aft adapter fittings fit into respective forward and aft post holes in the side of said truck bed.

6. A collapsible canopy apparatus set forth in claim 4, wherein said forward and aft adapter fittings fit into respective forward and aft post holes in the side of said truck bed.

7. A collapsible canopy apparatus set forth in claim 1, wherein each of said forward and aft adapter fittings includes:

one main beam with at least one socket positioned to accept said forward and aft pole assemblies, one hole positioned adjacent to the eyelet feature in said truck bed, and said main beam positioned such that said main beam contacts the upper inside rail of said truck bed and the other end of said main beam is in contact with the floor of said truck bed, one threaded J-shaped hook inserted into said hole in said main beam with said J-shaped hook attached to the eyelet feature in the truck bed, and one wing nut attached to a threaded portion of said threaded J-shaped hook such that tightening said wing nut forces said main beam against said truck bed fixing said main beam to said truck bed.

8. A collapsible canopy apparatus set forth in claim 3, wherein each of said forward and aft adapter fittings includes:

one main beam with at least one socket positioned to accept said forward and aft pole assemblies, one hole positioned adjacent to the eyelet feature in said truck bed, and said main beam positioned such that said main beam contacts the upper inside rail of said truck bed and the other end of said main beam is in contact with the floor of said truck bed, one threaded J-shaped hook inserted into said hole in said main beam with said J-shaped hook attached to the eyelet feature in the truck bed, and one wing nut attached to a threaded portion of said J-shaped hook such that tightening said wing nut forces said main beam against said truck bed fixing said main beam to said truck bed.

* * * * *